US008928435B2

(12) United States Patent
Despont et al.

(10) Patent No.: US 8,928,435 B2
(45) Date of Patent: Jan. 6, 2015

(54) ELECTROMECHANICAL SWITCH DEVICE AND METHOD OF OPERATING THE SAME

(75) Inventors: Michel Despont, Rueschlikon (CH); Christoph Hagleitner, Rueschlikon (CH); Charalampos Pozidis, Rueschlikon (CH); Abu Sebastian, Rueschlikon (CH)

(73) Assignee: International Business Machines Corporation, Armonk, NY (US)

( * ) Notice: Subject to any disclaimer, the term of this patent is extended or adjusted under 35 U.S.C. 154(b) by 5 days.

(21) Appl. No.: 13/807,049

(22) PCT Filed: Jun. 8, 2011

(86) PCT No.: PCT/IB2011/052490

§ 371 (c)(1),
(2), (4) Date: Dec. 27, 2012

(87) PCT Pub. No.: WO2012/001554

PCT Pub. Date: Jan. 5, 2012

(65) Prior Publication Data

US 2013/0105286 A1 May 2, 2013

(30) Foreign Application Priority Data

Jun. 29, 2010 (EP) ..... 10167752

(51) Int. Cl.
*H01H 51/22* (2006.01)
*H01H 59/00* (2006.01)
*H01H 47/00* (2006.01)

(52) U.S. Cl.
CPC ..... *H01H 59/00* (2013.01); *H01H 47/00* (2013.01); *H01H 59/0009* (2013.01)
USPC ..... 335/78; 200/181

(58) Field of Classification Search
CPC ... H01H 47/00; H01H 59/0009; H01H 59/00; H01H 1/0036; H01H 2057/006; B81B 2201/014; B81B 2203/0118; B81B 2203/058
USPC ..... 335/78; 200/181
See application file for complete search history.

(56) References Cited

U.S. PATENT DOCUMENTS 6,426,687 B1 * 7/2002 Osborn ..... 333/262
6,545,495 B2 * 4/2003 Warmack et al. ..... 324/601
6,587,021 B1 7/2003 Streeter (Continued)

FOREIGN PATENT DOCUMENTS

EP 1 610 459 A1 12/2005
WO 2009/138919 A1 11/2009

OTHER PUBLICATIONS

Bhushan, "Nanotribiology and nanomechanics of MEMS/NEMS and BioMEM/BioNEMS materials and devices" Microelectronic Engineering, Nov. 2006, pp. 387-412.

(Continued)

*Primary Examiner* — Bernard Rojas
(74) *Attorney, Agent, or Firm* — Tutunjian & Bitetto, P.C.; Jennifer R. Davis

(57) ABSTRACT

An electromechanical switch device includes a first switch portion, a second switch portion and an actuator device. The actuator device is configured to provide an actuation force, thereby actuating the first and second switch portion relative to each other to change from a disconnected to a connected state. The actuator device is further configured to provide the actuation force with a modulation at least when the first and second switch portion are in the connected state. A method of operating an electromechanical switch device is also provided.

19 Claims, 3 Drawing Sheets

(56) References Cited

U.S. PATENT DOCUMENTS

| | | | | |
|---|---|---|---|---|
| 7,151,425 | B2 | 12/2006 | Park et al. | |
| 7,221,247 | B2 | 5/2007 | Levitan et al. | |
| 7,288,873 | B2 * | 10/2007 | Salsman et al. | 310/322 |
| 7,486,163 | B2 | 2/2009 | Nielson et al. | |
| 7,605,675 | B2 | 10/2009 | Bar et al. | |
| 7,629,194 | B1 | 12/2009 | Schaffner et al. | |
| 2004/0061579 | A1 | 4/2004 | Nelson | |
| 2005/0104085 | A1 * | 5/2005 | Pinkerton et al. | 257/183 |
| 2005/0173234 | A1 | 8/2005 | Nielson et al. | |
| 2005/0173235 | A1 * | 8/2005 | Nielson et al. | 200/181 |
| 2010/0140066 | A1 * | 6/2010 | Feng et al. | 200/181 |
| 2012/0175230 | A1 * | 7/2012 | Hammond et al. | 200/181 |

OTHER PUBLICATIONS

Gammel et al., "RF MEMS and NEMS Technology, Devices and Applications" Bell Labs Technical Journal, 10(3), Jun. 2005, pp. 29-59.

Hyde, "Reliability of electromechanical switching devices—an engineer's views" Science Direct, Feb. 2003 (Abstract only) (3 pages).

Milosavljevic, "RF MEMS Switches" Microwave Review, Jun. 2004. (7 pages).

Silanto, "MEMS for mobile communications: microelectromechanical (MEM) components and systems can enhance future wireless systems" Circuits Assembly, Jun. 2002. (7 pages).

* cited by examiner

ELECTROMECHANICAL SWITCH DEVICE AND METHOD OF OPERATING THE SAME

FIELD OF THE INVENTION

The invention relates to an electromechanical switch device, e.g., a micro- or nano-electromechanical switch device and a method of operating the same.

BACKGROUND OF THE INVENTION

Electromechanical switches with dimensions in the micrometer and nanometer range, also referred to as micro-electromechanical (MEM) and nano-electromechanical (NEM) switches, are considered to be an attractive alternative to traditional solid state switches, such as, e.g., transistors and pin diodes. This is due to a more ideal switching characteristic (low-loss, linearity, steep switching) while having a smaller power requirement. In contrast to a solid state switch, a switching operation carried out by means of an electromechanical switch includes the mechanical actuation or movement of two switch portions relative to each other between a disconnected ("open") position and a connected ("closed") position, thereby preventing or allowing the flow of electricity through an electrical circuit.

MEM switches are for example targeting RF (radio frequency) applications such as e.g. in phased arrays and reconfigurable apertures for telecommunication systems, switching networks for satellite communications, and single-pole N-throw switches for wireless applications (portable units and base stations). More recently, NEM switches have been developed driven by the promise of a more ideal and lower power switching element for logic applications. Such switches may provide attributes like a near zero leakage, a very steep subthreshold slope with a mechanical delay of the order of nanoseconds and an electrical time constant of the order of picoseconds.

The attractiveness of electromechanical switching technology may, however, be limited by a relatively poor reliability. In particular, reliable electrical switching for a very large number of switching cycles may turn out to be difficult. Electromechanical switching has indeed been commercialized for applications for which the number of switching events is moderate ($<10^7$), e.g. RF application in radar systems, wireless communication and instrumentation. However, a large spectrum of applications would require switching cycles of higher orders of magnitude. As an example, logic applications may require $10^{12}$ (e.g. remote electronic, automotive, space applications) to $10^{16}$ (processor) cycles.

As a consequence, significant research is focusing on this subject, mainly by optimization of materials used for electrical contacts of the switch devices (e.g. usage of noble metals and conductive oxides) or by developing high force actuators (e.g. application of piezoelectric actuation in contrast to simpler electrostatic actuation). Even though such concepts have led to some improvement on the switching reliability, it is still far from the requirements concerning e.g. logic applications and demanding RF applications. In addition, such approaches may require more complex micromechanical structures and less standard materials, which has an impact on the fabrication cost of such devices.

U.S. Pat. No. 7,486,163 B2 describes an electromechanical switch structure including a fixed electrode and a movable electrode. The movable electrode is actuated by applying a voltage potential between the two electrodes. In order to effect the switching operation with a lower voltage, a modulation of the voltage potential is proposed. This is done in such a way as to inject energy into the mechanical system until there is sufficient energy in the system to achieve the actuation. At this, it is intended to bring the mechanical system into a resonant state. For this purpose, a feedback control system is applied in order to adapt the frequency of the modulation to the resonant frequency of the mechanical system, because the resonant frequency changes in the course of the actuation of the switch structure.

The aforesaid concept relates to the application of a lower voltage potential for actuation of the switch, and not to providing an improved switching reliability. Furthermore, the switch has a relatively complex design due to the provision of the feedback control system.

BRIEF SUMMARY OF THE INVENTION

According to a first aspect of the invention, an electromechanical switch device comprises a first switch portion, a second switch portion and an actuator device. The actuator device is configured to provide an actuation force, thereby actuating the first and second switch portion relative to each other in order to change from a disconnected to a connected state. The actuator device is further configured to provide the actuation force with a modulation at least when the first and second switch portion are in the connected state.

A modulation of the actuation force makes it possible to improve an electrical connection provided by the electromechanical switch device when the first and second switch portion are in the connected state. This effect further allows for generating the actuation force with a lower (mean) magnitude, which also reduces the mechanical stress during a switching event. Consequently, the endurance and thus the life time of the electromechanical switch device may be enhanced. At this, the electromechanical switch device may meet reliability requirements concerning e.g. logic applications and demanding RF applications. Moreover, provision of a lower actuation force may be associated with a simpler construction of the switch device and of the actuator device, respectively. A force modulation may furthermore reduce or tune a hysteresis behavior which may be inherent to the electromechanical switch device.

According to a preferred embodiment, the actuator device comprises a first electrode, a second electrode and a power source. The actuator device provides the actuation force by applying a voltage by means of the power source to the first and second electrode, thereby producing an electrostatic attraction between the first and second electrode. Such an electrostatic actuation may be realized in an easy and space saving manner.

According to another preferred embodiment, the power source comprises a direct voltage component and an alternating voltage component. By means of these two components, a modulated voltage and thus a modulated electrostatic actuation force may be provided in an easy and efficient manner.

According to another preferred embodiment, the actuator device is configured to provide the modulation of the actuation force with a constant frequency. This may in particular be realized by means of the aforesaid alternating voltage component, which may provide a steady modulation frequency.

According to another preferred embodiment, the actuator device is configured to provide the modulation of the actuation force in such a way that the amplitude of the modulation is less than a tenth part of a mean value of the actuation force. In this way, a reliable electrical contact may be established when the first and second switch portion of the electromechanical switch device are in the connected state.

According to another preferred embodiment, the electromechanical switch device is a micro-electromechanical switch device. Such a switch device may e.g. be used concerning a radio frequency application.

According to another preferred embodiment, the electromechanical switch device is a nano-electromechanical switch device. Such a switch device may e.g. used with respect to a logic application.

According to another preferred embodiment, the first switch portion of the electromechanical switch device comprises a beam structure and a contact element arranged on the beam structure. The second switch portion comprises at least a further contact element. The further contact element may be arranged on a carrier or substrate, respectively. The beam structure may be connected to an anchor structure, which is also arranged on the respective carrier or substrate.

Furthermore, according to another aspect of the invention, a method of operating an electromechanical switch device is proposed. In the method, an actuation force is provided, thereby actuating a first switch portion and a second switch portion of the electromechanical switch device relative to each other in order to change from a disconnected to a connected state. In order to improve the contact reliability, the actuation force is provided with a modulation at least when the first and second switch portion are in the connected state. This makes it further possible to operate the electromechanical switch device with a relatively low actuation force, which is favorable with respect to mechanical stress occurring when the electromechanical switch device is in the connected state.

According to a preferred embodiment, the first and second switch portion are switched between the disconnected and the connected state by intermittently providing the actuation force with a predefined switching frequency. Here, a frequency of the modulation of the actuation force exceeds the switching frequency, thereby allowing for reliable electrical contacting by means of the electromechanical switch device. The frequency of the modulation may for example be a multiple of the switching frequency.

BRIEF DESCRIPTION OF THE DRAWINGS

The invention will be explained in detail with reference to the figures in which.

DETAILED DESCRIPTION OF THE INVENTION

In the following, examples of electromechanical switch devices and methods of operating the same are described. Here, the application of a force modulation during a switching event is considered, thereby making possible an enhanced contact reliability. In order to demonstrate this effect, experiments were conducted with an atomic force microscope (AFM) in a conductive mode, which will be described further below in conjunction with FIG. 6.

Application of a force modulation in particular allows for establishing a better contact at lower force, so that mechanical stress acting on contact elements or materials, respectively, of the switch devices may be reduced. In this way, the endurance and the life time of the contact elements may be improved. Moreover, the switch devices and respective actuator devices used for carrying out a switching event may be realized with a simple construction.

With respect to fabrication of the depicted devices and structures, it is pointed out that usual methods, process steps and materials which are known from semiconductor fabrication technologies or from the fabrication of micro-electromechanical-systems (MEMS) may be applied. These process steps may e.g. include sputtering, deposition, doping, lithography, etching and other patterning processes, making possible a fabrication of the devices in miniaturized form.

Figure 1:
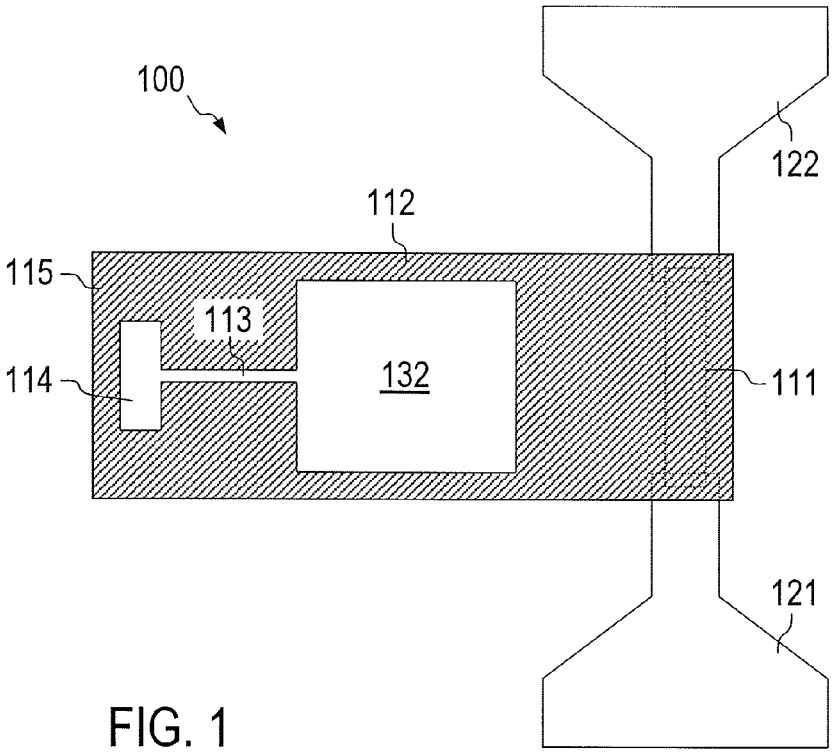
FIG. 1 shows a schematic top view of a micro-electromechanical switch.
Figure 2:
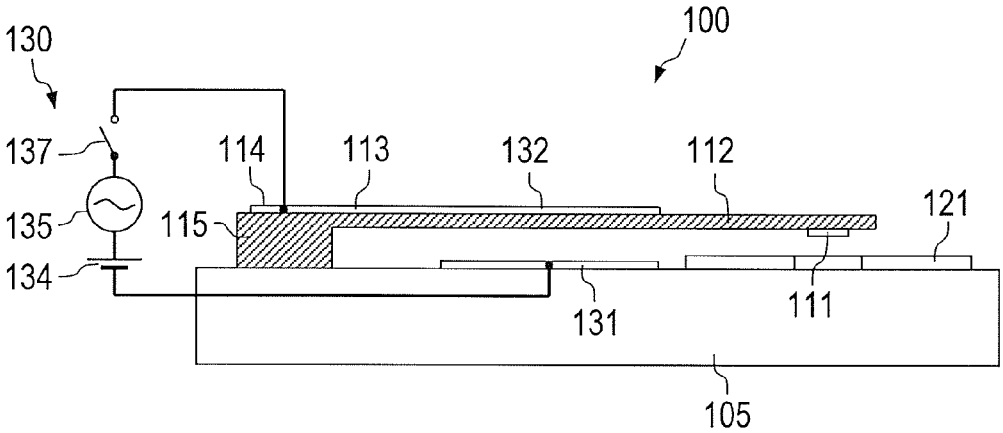
FIG. 2 shows a schematic side view of the switch of FIG. 1.

FIG. 1 shows a schematic top view of a micro-electromechanical (MEM) switch 100. A schematic side view of the MEM switch 100 is depicted in FIG. 2. The MEM switch 100 (i.e. a plurality of the same) may for example be used with respect to a RF application. Examples are radar systems, telecommunication systems, wireless communication and instrumentation.

The MEM switch 100 comprises a plane or rectangular beam structure 112 extending from or being connected to a support structure 115, wherein the support structure 115 is arranged on a surface of a substrate 105. The support structure 115 acts as an anchor for the beam structure 112, which may—starting from the disconnected or "open" state of the MEM switch 100 shown in FIG. 2—be moved or bent towards the substrate 105, thereby bringing the MEM switch 100 into a connected or "closed" state (not depicted).

In order to actuate such a deflection movement of the beam structure 112, the MEM switch 100 comprises an electrostatic actuator 130, which may be realized in an easy and space saving manner. The actuator 130 includes two plane electrodes 131, 132 ("pull down electrodes"). At this, the electrode 132 is arranged on an upper surface of the beam structure 112. The other electrode 131 is arranged on the surface of the substrate 105 in an area underneath the electrode 132.

The actuator 130 furthermore comprises a power source 134, 135 (including a direct voltage source 134 and an alternating voltage source 135 as described further below) by means of which a voltage may be applied between the two electrodes 131, 132, and a switch 137 for controlling the application of the voltage (cf. FIG. 2). The switch 137 may for example be a transistor or another electromechanical switch device. By applying an electric potential difference between the two electrodes 131, 132, an electrostatic attraction force may be generated between the same, so that the beam structure 112 is pulled in a direction towards the substrate 105 (not depicted). As soon as the application of the voltage potential to the electrodes 131, 132 is finished or interrupted, there is no attractive force, and thus the beam structure 112 may return to its initial state depicted in FIG. 2.

As further indicated in FIGS. 1 and 2, the upper electrode 132 arranged on the beam structure 112 may be connected to a contact area 114 arranged on the support structure 115 via a conductor 113. The other components of the actuator 130, i.e. the power source 134, 135, the switch 137 and respective conductors connecting these components to the two electrodes 131, 132, are (only) indicated in the form of an equivalent circuit diagram in FIG. 2.

The MEM switch 100 furthermore comprises a "bridging" contact arrangement including two separated contact elements 121, 122 and another strip-like contact element 111 by means of which the two separated contact elements 121, 122 may be connected to each other. At this, the contact element 111 is arranged on a lower surface of the beam structure 112 in the area of an end opposite the support structure 115.

The two other contact elements 121, 122 of the MEM switch 100 are arranged on the surface of the substrate 105 in the area of the contact element 111. Each contact element 121, 122 may have a substantially triangular portion and a strip-like portion. At this, the contact elements 121, 122 are arranged in such a way that the strip-like portions of the same oppose each other, and that end sections of the other contact element 111 overlaps a fraction of each of the strip-like portions of the contact elements 121, 122 (cf. FIG. 1). The contact elements 121, 122 may be connected to or may be part of an electrical or integrated circuit, respectively, which is disposed on the substrate 105 (not depicted).

With respect to applicable materials for the components of the MEM switch 100, the beam structure 112 may for example comprise a dielectric or isolating material, like for example silicon nitride. The same applies to the anchor structure 115. The conductive structures 113, 114, the electrodes 131, 132 and the contact elements 111, 121, 122 may comprise an appropriate conductive material, e.g. a metallic material. The substrate 105 may for example include a semiconductor or silicon substrate, respectively, or may alternatively comprise a different material like e.g. a glass material. Furthermore, the substrate 105 may comprise an isolating material or layer (at least) in the area of the contact elements 121, 122. This specification is to be considered as an example only.

Concerning the above described electrostatic actuation of the MEM switch 100 by applying a potential difference between the two electrodes 131, 132 which are arranged between the anchor 115 and the contact elements 111, 121, 122, the beam structure 112 may be deflected or bent in such a way that the contact element 111 is moved towards the two contact elements 121, 122 and touches the same (not depicted). In other words, the MEM switch 100 is switched from an open state to a closed state. In this position, an electrical connection is established between the two separate contact elements 121, 122 via the contact element 111, allowing the flow of electrical current between the two contact elements 121, 122.

As soon as the application of the voltage potential to the electrodes 131, 132 is cancelled or interrupted, there is no longer an attractive actuation force. Consequently, the beam structure 112 returns to the position depicted in FIG. 2, wherein the contact element 111 is spaced apart from the contact elements 121, 122, thereby preventing the flow of electrical current between the contact elements 121, 122. In other words, the MEM switch 100 is switched from a closed state to an open state.

Each switching event is associated with mechanical stress, which in particular may affect the contact elements 111, 121, 122. This is in particular the case for a large number of switching cycles. The mechanical stress may be reduced by reducing the actuation force applied for closing the MEM switch 100 and keeping the MEM switch 100 in the closed state. A mere reduction of the actuation force results, however, in a reduction of the electrical contact quality. In order to avoid this problem, it is intended to generate a modulated actuation force.

For this purpose, the actuator device 130 of the MEM switch 100 comprises a power source which includes a direct (DC) voltage source 134 and an alternating (AC) voltage source 135 (cf. FIG. 2). As a consequence, a modulated voltage being comprised of a DC voltage which is superimposed by an AC voltage is applied to the two electrodes 131, 132. In this way, a resulting actuation force acting on the beam structure 112 and having a periodic modulation may be provided in an easy and efficient manner. At this, the modulation has a constant frequency.

Any waveform may be considered with respect to the modulation of the voltage and thus with respect to the modulation of the actuation force, e.g. sine, sawtooth, square, etc. Furthermore, the AC voltage is preferably generated with an amplitude which is less than a tenth part of the DC voltage, so that the amplitude of the modulation of the actuation force similarly is less than a tenth part of a mean value of the actuation force. As an example, the amplitude of the modulation may be in the order of a few percent of the mean value of the actuation force.

Providing the actuation force with a modulation makes it possible to improve the electrical contact between the contact element 111 and the other contact elements 121, 122 in the closed state of the MEM switch 100. This is in particular the case when the amplitude of the modulation is less than a tenth part of a mean value of the actuation force. As a consequence, only a relatively low DC voltage may be provided by means of the DC voltage source 134, thereby providing the actuation force with a relatively low (mean) magnitude which is favorable concerning mechanical stress acting on the contact elements 111, 121, 122. Consequently, the endurance and thus the life time of the MEM switch 100 may be enhanced. At this, the MEM switch 100 may meet reliability requirements concerning e.g. demanding RF applications. Furthermore, it is also possible to provide the MEM switch 100 and the actuator 130 with a simple(r) construction (e.g. weak DC voltage source 134, smaller mechanical strength of the moving parts, etc.).

Depending on the application of the MEM switch 100, switching of the same may be carried out by intermittently providing the actuation force with a predefined switching frequency. The switching frequency may for example be dependent on or driven by a clock signal. In this connection, the frequency of the modulation of the actuation force may exceed the switching frequency, thereby allowing for a reliable contact behavior of the MEM switch 100. The frequency of the modulation may for example be a multiple of the switching frequency. As an example, concerning a switching frequency of 100 Mhz, the frequency of the modulation may for example be 500 Mhz.

Providing an actuation force with a modulation is not only restricted to MEM switches, but may also be applied with respect to other electromechanical switch devices. In particular nano-electromechanical (NEM) switch devices may be considered. An example is described in more detail in the following.

Figure 3:
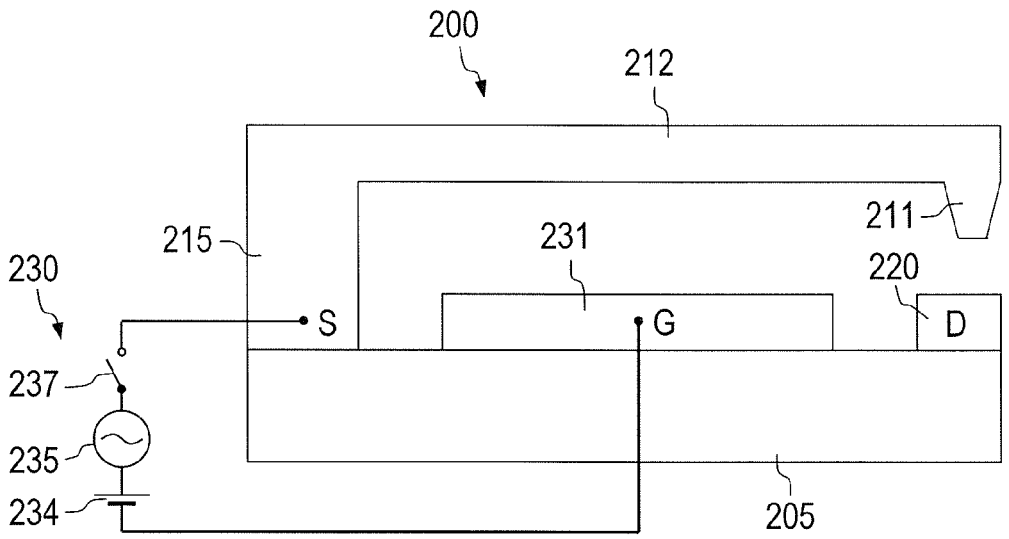
FIG. 3 shows a schematic side view of a nano-electromechanical switch.

FIG. 3 shows a schematic side view of a NEM switch 200. The NEM switch 200 (i.e. a plurality of the same) may for example be used with respect to a logic application, e.g. a microcontroller, processor, etc. The NEM switch 200 has a functionality comparable to a field effect transistor (FET). Consequently, respective electrodes or terminals are correspondingly denoted as "source" S, "gate" G and "drain" D in the following, as also indicated in FIG. 3.

The NEM switch 200 comprises a beam structure 212, which is also referred to as cantilever beam 212 in the following. The cantilever beam 212 is arranged on a support structure 215 and may be formed integrally with the same. The support structure 215 is arranged on a surface of a substrate 205, and acts as an anchor for the cantilever beam 212, which may—starting from the disconnected or "open" state of the NEM switch 200 shown in FIG. 3—be moved or bent towards the substrate 205, thereby bringing the NEM switch 100 into a connected or "closed" state (not depicted).

The cantilever beam 212 furthermore comprises a tip structure 211 which is located at an end section of the cantilever beam 212 opposite the support structure 215. Underneath the tip structure 211, a contact element 220, also referred to as drain terminal D, is arranged on the surface of the substrate 205. In the closed state of the NEM switch 200, the tip structure 211 touches and thus contacts the contact element 220. This makes possible a flow of electrical current, also referred to as drain current ID in the following, between the support 215 acting as source terminal S and the contact element 220 acting as drain terminal D via the cantilever beam 212, provided that a respective potential difference is existent between source S and drain D.

In order to actuate a deflection movement of the cantilever beam 212, the NEM switch 200 is provided with an electrostatic actuator 230. Here, the cantilever beam 212 additionally acts as an electrode of the actuator 230, wherein the actuator 230 comprises a further electrode 231. The further electrode 231, which is also referred to as gate terminal G, is arranged on the surface of the substrate 205 underneath the cantilever beam 212 (or a fraction thereof) and between the anchor 215 and the contact element 220, wherein a gap ("air-gap") is provided between the electrode 231 and the beam structure 212.

Further components of the actuator 230 are (only) indicated in the form of an equivalent circuit diagram in FIG. 3. In this connection, the actuator 230 comprises a power source 234, 235 (including a DC voltage source 234 and an AC voltage source 235 as described further below) by means of which a voltage may be applied between the two electrodes 212, 231. Concerning the cantilever beam 212, the respective electric potential is applied to the support structure 215 acting as source terminal S, as indicated in FIG. 3. The voltage applied by means of the power source 234, 235 is also be referred to as gate to source voltage VGS in the following. The actuator 230 furthermore comprises a switch 237 for controlling the application of the voltage VGS. The switch 237 may for example be a transistor or another electromechanical switch device.

With respect to applicable materials for the components of the NEM switch 200, the cantilever beam 212, the tip 211 and the support structure 215 comprise a conductive material, for example a doped semiconductor material or doped silicon, respectively. The same applies to the electrode 231 and the contact element 220. The substrate 205 may for example be a semiconductor or silicon substrate, respectively, and may comprise further (not depicted) structures, doped areas, layers, etc. An example is an isolating layer in the area of the electrode 231. This specification is to be considered as an example only.

By applying an electric potential difference VGS between the two electrodes 212, 231, an electrostatic attraction force may be generated between the same, so that the cantilever beam 212 is pulled in a direction towards the substrate 205 (not depicted). In other words, the NEM switch 200 is switched from an open state to a closed state. In this state, an electrical connection is established between the tip structure 211 and the contact element 220, allowing the flow of a drain current ID.

As soon as the application of the voltage potential VGS to the electrodes 212, 231 is finished or interrupted, there is no attractive force, and thus the cantilever beam 212 may return to its initial state depicted in FIG. 3, wherein the tip structure 211 is spaced apart from the contact element 220, and the flow of a drain current ID is prevented. In other words, the NEM switch 200 is switched form a closed state to an open state.

Each switching event is associated with mechanical stress, which in particular may affect the tip structure 211 and the contact element 220. This is in particular the case for a large number of switching cycles. In order to avoid this problem, it is again intended to generate a modulated actuation force.

For this purpose, the actuator device 230 of the NEM switch 200 comprises a power source which includes a DC voltage source 234 and an AC voltage source 235. As a consequence, a modulated voltage VGS is applied to the two electrodes 212, 231, thus resulting in an actuation force having a periodic modulation with a constant frequency. Any waveform may be considered with respect to the modulation, e.g. sine, sawtooth, square, etc. Moreover, the modulation is preferably provided in such a way that the amplitude of the modulation is less than a tenth part of a mean value of the actuation force. As an example, the amplitude of the modulation may be in the order of a few percent of the mean value of the actuation force.

Providing the actuation force with a modulation allows for an improvement of the electrical contact between the tip structure 211 and the contact element 220 in the closed state of the NEM switch 200. This is in particular the case when the amplitude of the modulation is less than a tenth part of a mean value of the actuation force. Consequently, only a relatively low DC voltage may be provided by means of the DC voltage source 234, thereby providing the actuation force with a relatively low (mean) magnitude which is favorable concerning mechanical stress acting on the tip structure 211 and the contact element 220. In this way, the endurance and thus the life time of the NEM switch 200 may be enhanced, so that the NEM switch 200 may e.g. be used with respect to a (demanding) logic application. Furthermore, it is also possible to provide the NEM switch 200 and the actuator 230 with a simple(r) construction (e.g. weak DC voltage source 234, smaller mechanical strength of the moving parts, etc.).

Depending on the application of the NEM switch 200, switching of the same may be carried out by intermittently providing the actuation force with a predefined switching frequency. The switching frequency may for example be dependent on or driven by a clock signal. In this connection, the frequency of the modulation of the actuation force may exceed the switching frequency, thereby allowing for a reliable contact behavior of the NEM switch 200. The frequency of the modulation may for example be a multiple of the switching frequency. As an example, concerning a switching frequency of 100 Mhz, the frequency of the modulation may for example be 500 Mhz.

Figure 4:
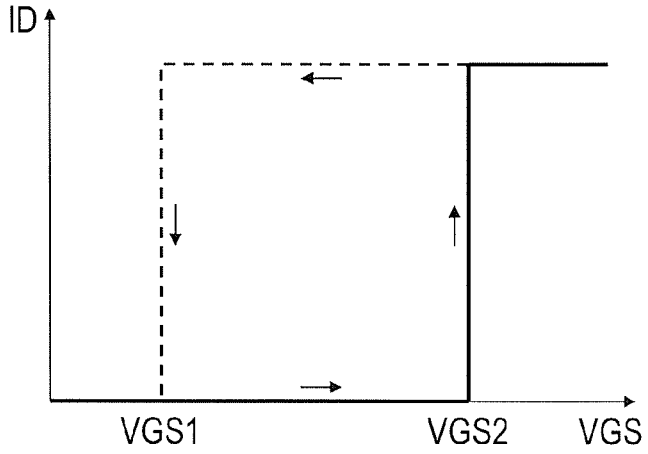
FIG. 4 shows a diagram illustrating a hysteresis behavior.

Providing an improved electrical contact by means of a modulated actuation force may also be favorable with respect to a hysteresis behavior which may be inherent to an electromechanical switch. In this connection, FIG. 4 shows a schematic characteristic of a drain current ID depending on a gate to source voltage VGS illustrating such a hysteresis behavior when operating a NEM switch 200. It is pointed out that a similar behavior may also occur when operating the MEM switch 100 depicted in FIGS. 1 and 2.

As shown in FIG. 4, starting from a voltage VGS of zero (i.e. open state of the NEM switch 200), the voltage VGS steadily increases, wherein no current ID is flowing ("zero off-current"). Closure of the NEM switch 200 and thus a steep rise of the current ID to a certain magnitude ("zero subthreshold swing") appears at a voltage VGS2 ("pull-in voltage"). The current ID (i.e. the magnitude of the current ID) remains the same when the voltage VGS is further increased. In other words, a further increase in the voltage VGS may increase the attraction force, but not the current ID. Subsequently, when the voltage VGS decreases, opening of the NEM switch 200 and thus a drop of the current ID does not occur at the voltage VGS2, but at a lower voltage VGS1 ("pull-out voltage").

The above described modulation of the voltage VGS and thus of the actuation force may cause a reduction of such a hysteresis behavior. In particular, a reduction of the voltage VGS2 may be achieved.

The hysteresis behavior may also be utilized concerning application of a NEM switch 200 in the form of a memory cell. Here, the two switching states of the NEM switch 200 (open/closed) represent memory states. For operation, a base voltage VGS having a magnitude between VGS1 and VGS2 may be applied to the NEM switch 200. Programming of the NEM switch 200 may be carried out by temporarily increasing the voltage VGS to exceed the voltage VGS2, and then returning to the base voltage between VGS1 and VGS2. In this way, the NEM switch 200 is switched into the closed state, which may be "read" by detecting a drain current ID different from zero. Erasing this memory state may be carried out by temporarily decreasing the voltage VGS to be smaller than VGS1, and then returning to the base voltage between VGS1 and VGS2. Consequently, the NEM switch 200 is switched back into the open state, which may again be "read" by detecting that the drain current ID is zero. With respect to such a memory operation, the hysteresis may also be tuned by application of an appropriate modulation of the voltage VGS and thus of the actuation force.

It is pointed out that a NEM switch 200 may also be designed in such a way that the voltage VGS1 is negative, and the voltage VGS2 is positive. In this way, the above mentioned base voltage having a magnitude between VGS1 and VGS2 may be zero. In this connection, tuning of the hysteresis behavior by mean of a modulated actuation force may be realized, as well.

Figure 5:
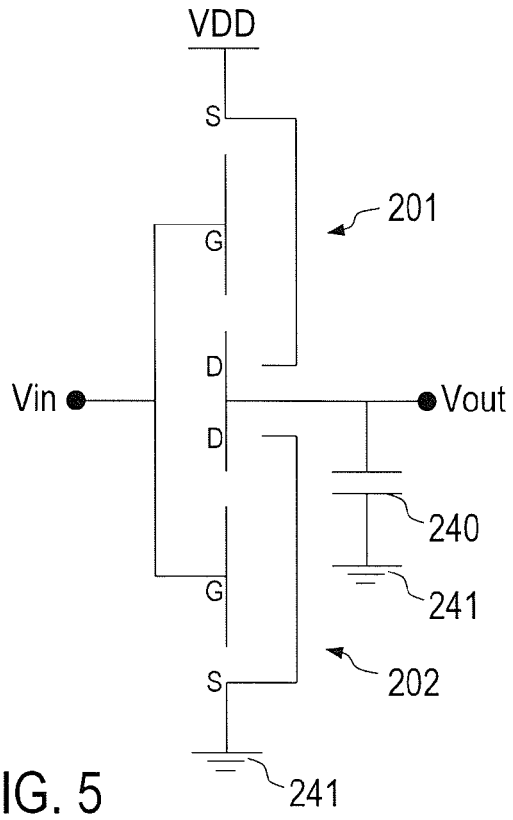
FIG. 5 shows a circuit diagram of an inverter including two nano-electromechanical switches.

FIG. 5 shows an equivalent circuit diagram of an inverter, illustrating a further example of the application of NEM switches. The inverter includes two NEM switches 201, 202, wherein each of the switches 201, 202 has a construction similar to the NEM switch 200 of FIG. 3. The respective terminals S, G, D of the switches 201, 202 are also indicated in FIG. 5.

The inverter may for example be a C-NEM device, i.e. a complementary nano-electromechanical inverter. At this, for example the switch 201 may be a p-relay comprising a p-type conducting support 215, beam 212 and tip 211. The other switch 202 may be a n-relay comprising a n-type conducting support 215, beam 212 and tip 211.

The two switches 201, 202 are connected to each other at the drain terminals D. The drain terminals D are further connected to an output terminal by means of which an output signal or voltage Vout is output. A load capacitance 240 connected to a ground potential 241 is also connected to the drain terminals D of the switches 201, 202. The load capacitance 240 may represent a combination of parasitic inverter capacitances and an external load capacitance, which are charged when switching the inverter.

Moreover, a power supply voltage VDD is applied to the source terminal S of the switch 201, and the ground potential 241 is applied to the source terminal S of the switch 202. An input terminal by means of which an input signal or voltage Vin may be applied to the inverter is connected to the gate terminals G of the switches 201, 202.

By means of the depicted inverter, either the voltage VDD or the ground potential 241 may be applied as input signal Vin. Consequently, the inverted signals ground 241 or VDD are output as output signal Vout. In detail, concerning the input of VDD, the switch 201 remains open (because gate G and source S of the switch 201 have the same potential) and the switch 202 is closed (because gate G and source S of the switch 202 have a different potential), so that the ground potential 241 applied to the source S of the switch 202 is "transferred" to the output terminal. Vice versa, concerning the input of the ground potential 241, the switch 201 is closed (because gate G and source S of the switch 201 have a different potential) and the switch 202 remains open (because gate G and source S of the switch 202 have the same potential), so that the voltage VDD applied to the source S of the switch 201 is "transferred" to the output terminal.

Concerning the inverter circuit of FIG. 5, provision of a modulated actuation force for the switches 201, 202 may be considered in order to achieve the above mentioned advantages, in particular a more reliable contact behavior. In order to achieve this, the power supply voltage VDD may be a DC voltage which is superimposed by a small AC voltage component. Concerning further details, reference is made to the above description.

In order to demonstrate the beneficial effects of a force modulation on contact quality, experiments were performed on a conductive-mode AFM microscope setup. At this, the respective AFM tip-to-sample interface may simulate nanoscale contacts as occurring in NEM switches.

The applied AFM microscope comprised a silicon cantilever with a platinum silicide tip. A sample or bottom electrode arranged underneath the cantilever was contacted by the tip. An xyz scanner and an optical deflection sensing setup were used to maintain a constant DC loading force during the experiments. A DC voltage was applied between the cantilever and the bottom electrode. A dither piezo beneath the base of the cantilever was used to force the cantilever and hence to provide an AC force modulation.

The experiments showed that the electrical contact quality improves as the DC loading force increases as evidenced from an increase in the current that flows through the sample. Furthermore, a steady improvement in contact quality was observed with increasing AC force modulation. Even at low loading forces, a relatively small sinusoidal force modulation lead to a significantly improved conduction. Experimental and simulation studies showed that the AC force modulation was only a fraction of the DC loading force. Moreover, a simultaneous reduction in the lateral forces and hence friction and wear was detected.

Figure 6:
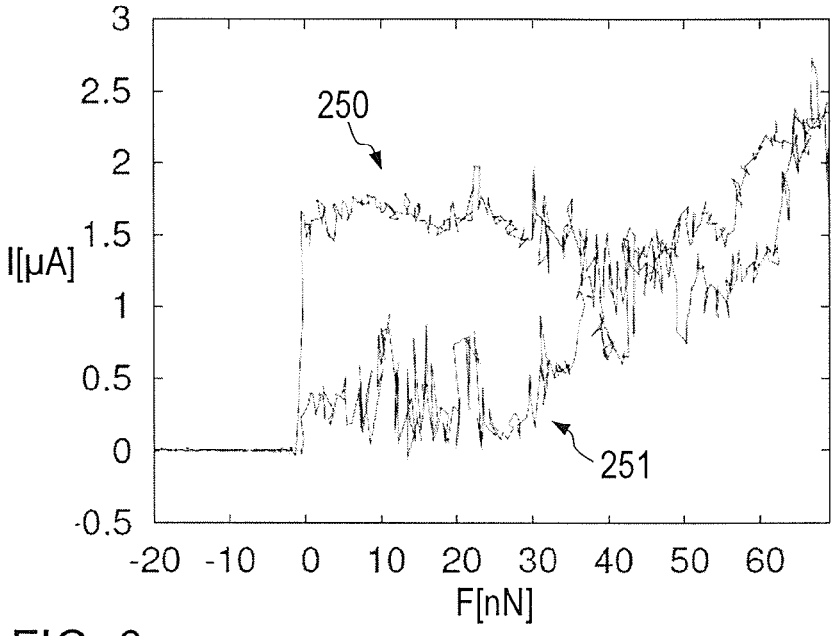
FIG. 6 shows measurement curves obtained with the aid of an atomic force microscope and illustrating the effect of modulation of a loading force on electrical conductivity.

For way of illustration, FIG. 6 shows measured curves 250, 251 of a current I in μA depending on a loading force F in nN, which were obtained in these experiments. The curve 250 was measured with force modulation, and the curve 251 was measured without the force modulation. As can be concluded from a comparison of the curves 250, 251, the force modulation improves the magnitude of the current I, and thus the contact quality. This is in particular the case with respect to low loading forces.

The embodiments described in conjunction with the drawings are examples. Moreover, further embodiments may be realized which comprise further modifications. As an example, the mentioned specifications concerning potential materials, frequencies, etc. are to be considered as examples only, which may be exchanged by other specifications. Furthermore, electromechanical switch devices may be realized having a different construction or geometry compared to the depicted switch devices 100, 200. Such switch devices may furthermore comprise different or other structures and layers, respectively.

As an example, concerning the MEM switch 100 of FIGS. 1 and 2, instead of providing a conductive structure on the beam structure 112 including the electrode 132, the conductor 113 and the contact area 114, it is possible to simply provide a plane electrode on the beam structure 112 extending to the anchor structure 115. Another potential modification consists in providing a beam structure having a design different from the rectangular beam structure 112 depicted in FIG. 2.

Furthermore, it is for example possible to modify the MEM switch 100 in such a way that an electrical current may flow—comparable to the NEM switch 200 of FIG. 3—via the beam structure 112 in the closed state of the switch. For this purpose, for example a respective conductive structure comprising e.g. a metallic material may be arranged on the beam structure 112. Furthermore, instead of the two contact elements 121, 122, only one contact element arranged on the substrate 105 and to be contacted by the aforesaid conductive structure may be provided with respect to such a modified MEM switch.

Concerning a potential modification of the NEM switch 200 of FIG. 3, it is for example possible to omit the tip structure 211, provided that an electrical connection between the cantilever beam 212 and the electrode 231 is avoided in the closed state of the switch.

Moreover, it is possible to realize a modulation of an actuation force different from superimposing a DC voltage with an AC voltage. As an example, a (base) actuation force may be provided by means of applying a DC voltage to two electrodes, wherein the modulation of the respective electrostatic attraction force is provided by means of another component, e.g. a piezoelectric component. Concerning for example the MEM switch 100 of FIGS. 1 and 2, a respective piezoelectric element could be arranged on the beam structure 112.

Instead of carrying out an actuation based on an electrostatic attraction between two electrodes, different actuation schemes may be employed. An example is an electromagnetic attraction between e.g. two electromagnets or between a permanent magnet and an electromagnet. At this, it is possible to provide a modulated actuation force solely based on electromagnetic attraction (e.g. driving an electromagnet with a DC voltage which is superimposed by an AC voltage), or to combine a (base) electromagnetic attraction with another component, e.g. a piezoelectric component.

Furthermore, concerning the above described switches 100, 200, the actuation force applied for actuating the respective switch 100, 200 to change from a disconnected to a connected state is throughout provided with a modulation, i.e. both in the closed state and in a state before that. However, it is alternatively possible to only provide a temporary modulation of the actuation force. In particular, a modulation may only be applied when the switch is substantially in the connected state. Concerning for example an electrostatic actuation, this may for example be realized by initially applying a DC voltage to two electrodes, and subsequently adding or switching an AC voltage to the DC voltage. At this, e.g. a predetermined delay time may be applied which matches the switching characteristic of the respective switch.

Moreover, it is pointed out that numerous systems comprising a plurality or an array of electromechanical switch devices may be realized, wherein the switch devices are actuated with an actuation force according to the above described approaches and concepts, thereby allowing for an enhanced contact reliability at lower force. Such systems may include RF applications such as e.g. in phased arrays and reconfigurable apertures for telecommunication systems, radar systems, instrumentation, switching networks for satellite communications, and single-pole N-throw switches for wireless applications (portable units and base stations). A further example are logic applications like e.g. remote electronic, automotive, and space applications.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

REFERENCE LIST

100 MEM switch
105 Substrate
111 Contact element
112 Beam structure
113 Conductor
114 Contact area
115 Support structure
121, 122 Contact element
130 Actuator
131, 132 Electrode
134 DC voltage source
135 AC voltage source
137 Switch
200 NEM switch
201 P-relay
202 N-relay
205 Substrate
211 Tip structure
212 Cantilever beam
215 Support structure
220 Contact element
230 Actuator
231 Electrode
234 DC voltage source
235 AC voltage source
237 Switch
240 Load capacitance
241 Ground
250 Measured Curve (with force modulation)
251 Measured Curve (without force modulation)
D Drain
I Current
ID Drain current
F Loading force
G Gate
S Source
VDD Power supply voltage
VGS, VGS1, VGS2 Gate to Source Voltage
Vin Input Voltage
Vout Output Voltage

The invention claimed is:

1. An electromechanical switch device, comprising:

a first switch portion, a second switch portion and an actuator device, wherein the actuator device is configured to provide an actuation force, thereby actuating the first and second switch portion relative to each other to change from a disconnected to a connected state, wherein the first switch portion comprises a cantilever beam structure and a contact element arranged on the cantilever beam structure, and wherein the second switch portion comprises at least a further contact element, wherein the actuator device is further configured to provide the actuation force with a modulation at least when the first and second switch portion are in the connected state, and wherein a predefined switching frequency is intermittently provided to the actuation force, and the predefined switching frequency is driven by a clock signal.

2. The electromechanical switch device according to claim 1, wherein the actuator device comprises a first electrode, a second electrode and a power source, and wherein the actuator device provides the actuation force by applying a voltage by means of the power source to the first and second electrode, thereby producing an electrostatic attraction between the first and second electrode.

3. The electromechanical switch device according to claim 2, wherein the power source comprises a direct voltage component and an alternating voltage component.

4. The electromechanical switch device according to claim 1, wherein the actuator device is configured to provide the modulation of the actuation force with a constant frequency.

5. The electromechanical switch device according to claim 1, wherein the actuator device is configured to provide the modulation of the actuation force in such a way that the amplitude of the modulation is less than a tenth part of a mean value of the actuation force.

6. The electromechanical switch device according to claim 1, wherein the electromechanical switch device is a microelectromechanical switch device.

7. The electromechanical switch device according to claim 1, wherein the electromechanical switch device is a nanoelectromechanical switch device.

8. A method of operating an electromechanical switch device, comprising:

providing an actuation force, thereby actuating a first switch portion and a second switch portion of the electromechanical switch device relative to each other to change from a disconnected to a connected state, wherein the first switch portion comprises a cantilever beam structure and a contact element arranged on the beam structure, and wherein the second switch portion comprises at least a further contact element, and wherein the actuation force is provided with a modulation at least when the first and second switch portion are in the connected state, and wherein a predefined switching frequency is intermittently provided to the actuation force, and the predefined switching frequency is driven by a clock signal.

9. The method according to claim 8, wherein the modulation of the actuation force has a constant frequency.

10. The method according to claim 8, wherein the modulation of the actuation force is provided in such a way that the amplitude of the modulation is less than a tenth part of a mean value of the actuation force.

11. The method according to claim 8, wherein the first and second switch portion are switched between the disconnected and the connected state by intermittently providing the actuation force with a predefined switching frequency, and wherein a frequency of the modulation of the actuation force exceeds the switching frequency.

12. The method according to claim 8, wherein providing the actuation force is carried out by applying a voltage to a first electrode and a second electrode, thereby producing an electrostatic attraction between the first and second electrode.

13. The method according to claim 12, wherein the voltage potential is applied to the first and second electrode by applying a direct voltage which is superimposed by an alternating voltage.

14. The electromechanical switch device according to claim 1, wherein a frequency of the modulation exceeds the predefined switching frequency.

15. The method according to claim 8, wherein a frequency of the modulation exceeds the predefined switching frequency.

16. The electromechanical switch device according to claim 1, wherein the contact element arranged on the cantilever beam structure and the further contact element are connected to each other using a strip-like bridging contact.

17. The method according to claim 8, wherein the contact element arranged on the cantilever beam structure and the further contact element are connected to each other using a strip-like bridging contact.

18. The electromagnetic switch device according to claim 1, wherein a deflection movement of the cantilever beam structure is actuated, and the cantilever beam structure acts as an electrode for the actuator, wherein the actuator acts as an additional electrode.

19. The method according to claim 1, wherein a deflection movement of the cantilever beam structure is actuated, and the cantilever beam structure acts as an electrode for the actuator, wherein the actuator acts as an additional electrode.

* * * * *